US006563414B2

(12) United States Patent
Yu

(10) Patent No.: US 6,563,414 B2
(45) Date of Patent: May 13, 2003

(54) SWITCH HAVING A BIMETAL PLATE WITH TWO LEGS

(76) Inventor: Tsung-Mou Yu, No. 4, Alley 2, Lane 23, Sec. 3, Pa Te Rd., Panchiao, Taipei (TW)

( * ) Notice: Subject to any disclaimer, the term of this patent is extended or adjusted under 35 U.S.C. 154(b) by 103 days.

(21) Appl. No.: 09/839,104

(22) Filed: Apr. 19, 2001

(65) Prior Publication Data

US 2002/0153990 A1 Oct. 24, 2002

(51) Int. Cl.[7] ..... H01H 71/16; H01H 71/02; H01H 71/58

(52) U.S. Cl. ..... 337/66; 337/37; 337/68; 337/85; 337/112

(58) Field of Search ..... 337/66, 68, 91, 337/333, 334, 345, 379, 53, 59, 74–76, 79, 37, 39, 85, 112, 113, 140; 200/553–557

(56) References Cited

U.S. PATENT DOCUMENTS 3,872,417 A * 3/1975 Hufschmid ..... 200/406
4,068,203 A * 1/1978 Unger ..... 337/107
4,363,016 A * 12/1982 Unger ..... 337/56
4,518,943 A * 5/1985 Giessner ..... 200/573
4,528,538 A * 7/1985 Andersen ..... 337/2
4,868,535 A * 9/1989 Janniere et al. ..... 337/66
5,248,954 A * 9/1993 Chiang ..... 337/66
5,453,725 A * 9/1995 You et al. ..... 200/61.19
5,694,106 A * 12/1997 Wang ..... 337/53

FOREIGN PATENT DOCUMENTS

DE 3313465 A1 * 10/1984 ..... H01H/73/30

* cited by examiner

*Primary Examiner*—Anatoly Vortman

(57) ABSTRACT

A switch device includes a switch case having a passage in a top thereof so as to receive a button therein. A non-conductive plate extends laterally from the button. A first terminal plate and a second terminal plate respectively extend from the casing. A first contact point extends from a side of the second terminal plate. A bimetal plate is connected to the first terminal plate and has two legs extending therefrom. A conductive member is connected between the two legs and connected to the second terminal plate when the button is pushed. The non-conductive plate is located between the conductive member and the second terminal plate when the button jumps up and the two legs are deformed away from the second terminal plate.

10 Claims, 9 Drawing Sheets

SWITCH HAVING A BIMETAL PLATE WITH TWO LEGS

FIELD OF THE INVENTION

The present invention relates to a switch device employing a bimetal plate which has a body and two legs extending from the body. A conduction member is connected between the two legs. The area of the bimetal plate is smaller than the conventional bimetal plate.

BACKGROUND OF THE INVENTION

A conventional bimetal plate 6' used in a switch device is shown in FIG. 5*b* and generally is an elongated metal plate involving two metal materials therein. Two ends of the bimetal plate 6' are pressed to be a recess 61' and a protrusion portion 62' is punched in a mediated portion of the bimetal plate 6'. The protrusion portion 62' makes the mediate portion be higher than the two ends and the two recesses 61' provide a tension to let the bimetal plate 6' have a tendency to jump upward when heated. The conventional bimetal plate 6' has a certain width and size limitation so that the size of the switch receiving the bimetal plate 6' cannot be reduced. Besides, the east of the bimetal plate 6' is high so that the larger area the bimetal plate 6' is, the higher the cost of the switch device is.

The present invention intends to provide an improved bimetal plate that has a body with two legs and has smaller area than the conventional bimetal plate.

SUMMARY OF THE INVENTION

The primary object of the present invention is to provide a switch device that employs a U-shaped bimetal plate which has a smaller area compared with the conventional bimetal plate. In accordance with one aspect of the present invention, there is provided a switch device that comprises a switch case having a passage for receiving a button therein. A non-conductive plate extends laterally from the button and is located in the switch case. A first terminal plate and a second terminal plate respectively extend from an underside of the case. A bimetal plate has a body and two legs extend from the body. The body is connected to the first terminal plate. A conductive member is connected between the two legs and contacts the second terminal plate. The L-shaped non-conductive plate is movably located between the conductive member and the second terminal plate when the two legs are deformed away from the second terminal plate as a result of current overriding.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
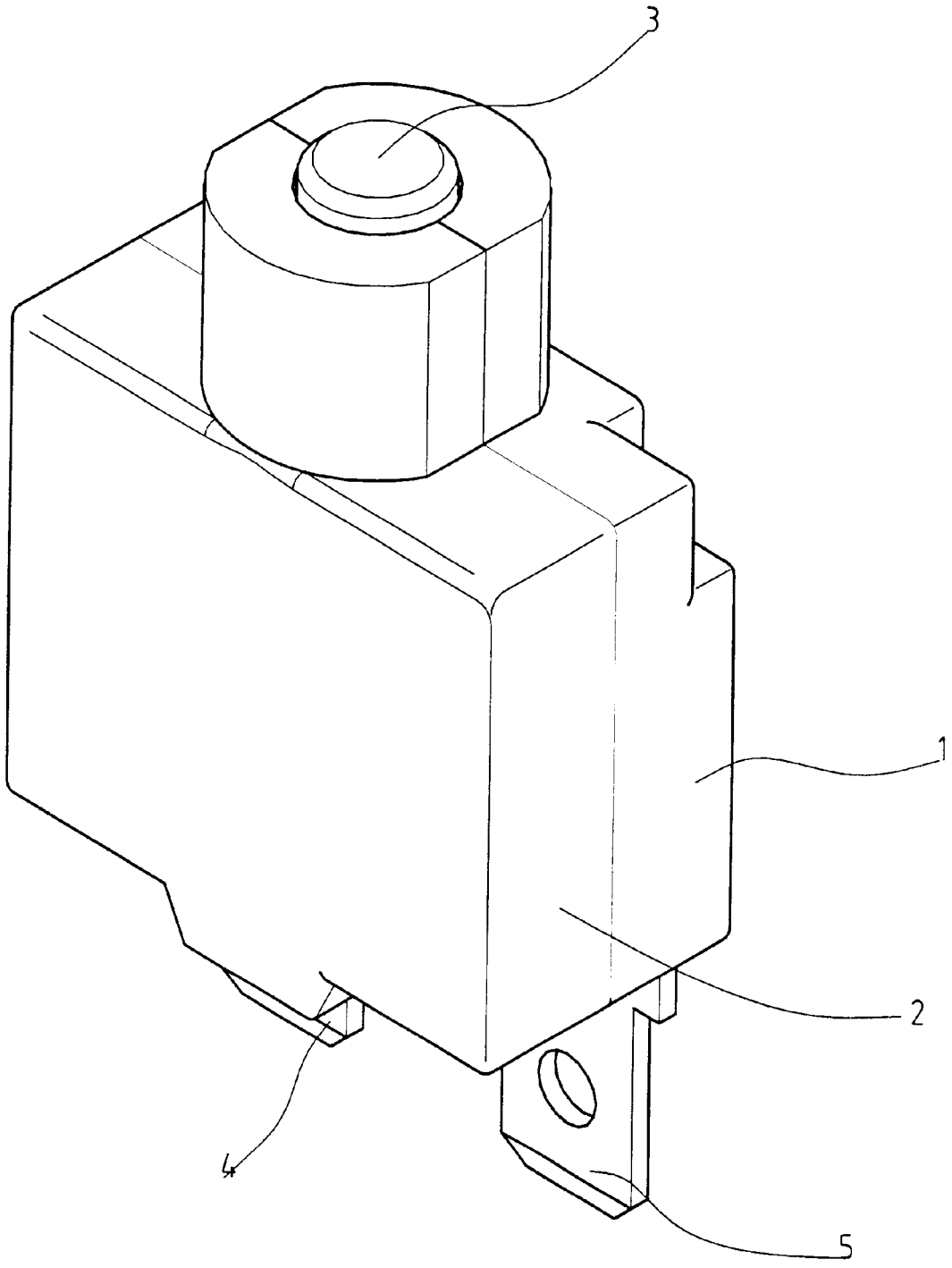
FIG. 1 is a perspective view to show the switch device of the present invention.
Figure 2:
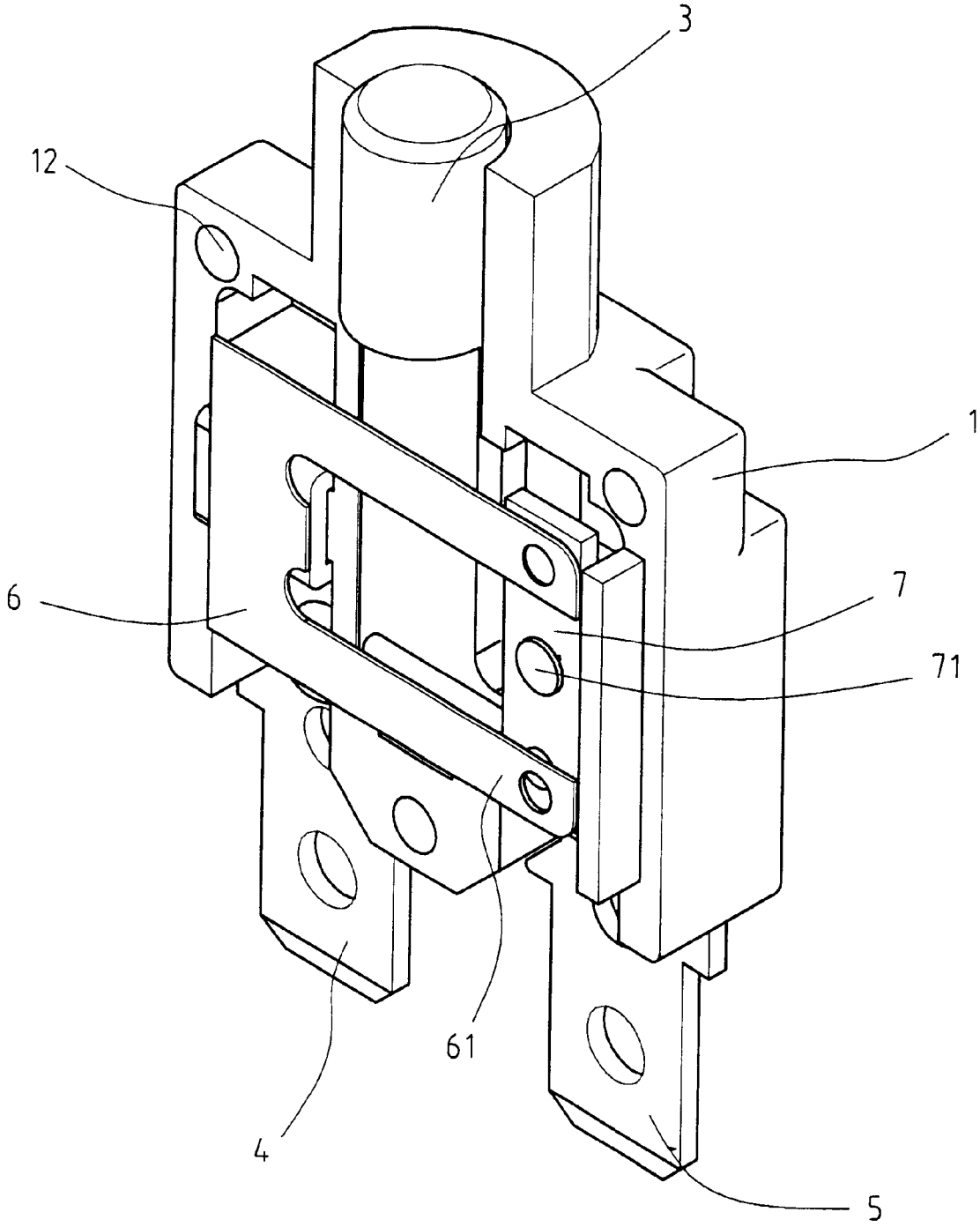
FIG. 2 is a perspective view to show a first part of the switch device of the present invention.
Figure 3:
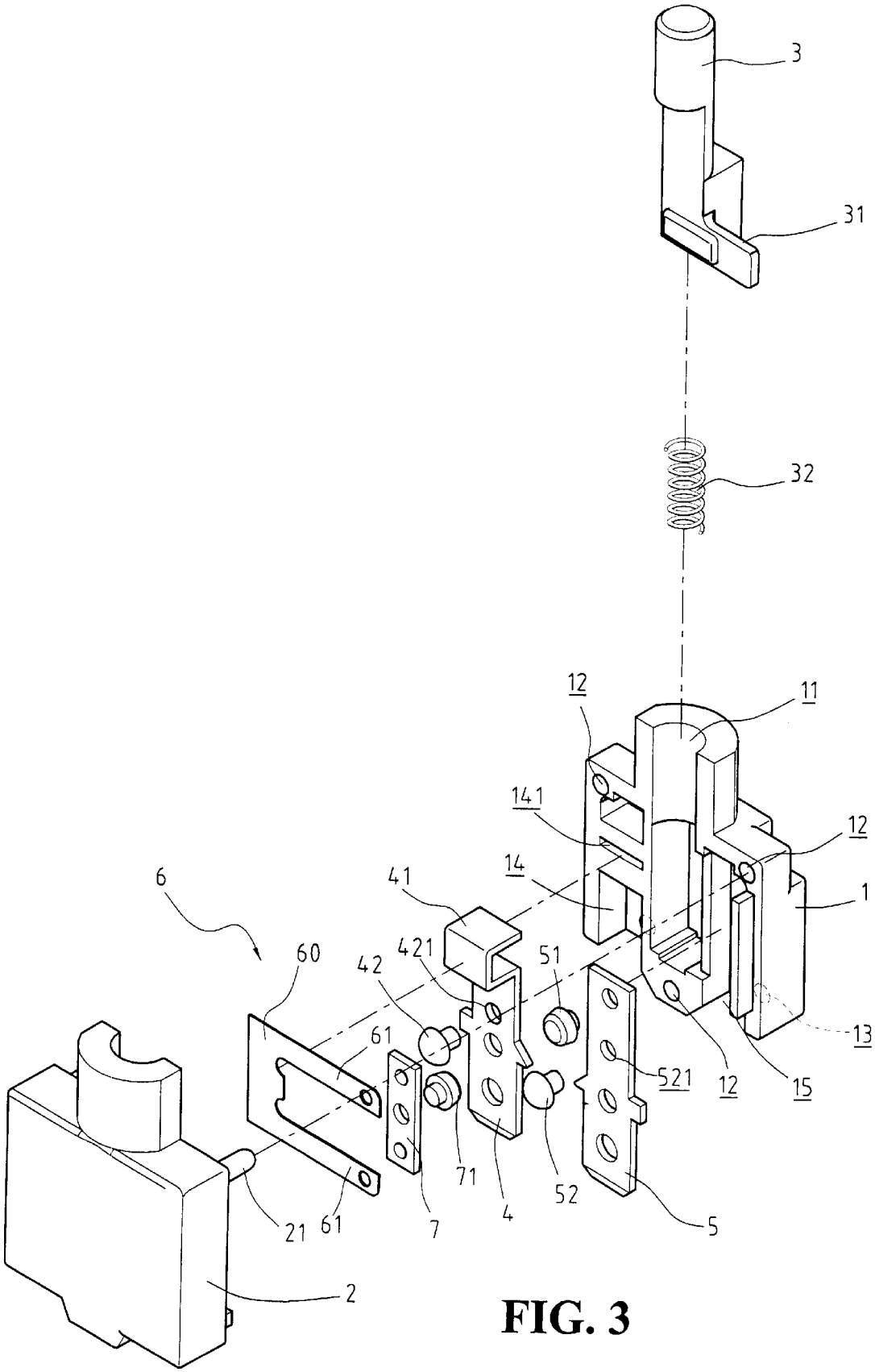
FIG. 3 is an exploded view to show the switch device of the present invention.

Referring to FIGS. 1 to 3, the switch device of the present invention comprises a switch case composed of a first part 1 and a second part 2. Three recesses 12 are defined in a surface of the first part 1 and three rods 21 (only two are shown) extend from the second part 2, the rods 21 engaged with the recesses 12 to combine the first part 1 and the second part 2. A passage 11 is defined through a top of the case and two slots 14, 15 are respectively defined in an underside of the case. A button 3 is movably received in the passage 11 and a non-conductive plate 31 extends laterally from the button 3 and is located in the switch case. A spring 32 is biased between the button 3 and an inner periphery of the passage 11.

A first terminal plate 4 and a second terminal plate 5 are respectively engaged with the two slots 14, 15. A slit 141 is defined in the first part 1 and the first terminal plate 4 has a hook-like end 41 which is engaged with the slit 141. The first terminal plate 4 and the second terminal plate 5 each have a connection hole 421/521, and the first part 1 has two engaging holes 13, 14 defined therein. Two rivets 42, 52 respectively extend through the connection holes 421, 521 and engage with the engaging holes 13, 14 to fixedly position the two terminal plates 4, and 5. A first contact point 51 extends from a side of the second terminal plate 5 and a second contact point 71 extends from a side of the conductive member 7.

Figure 8A:
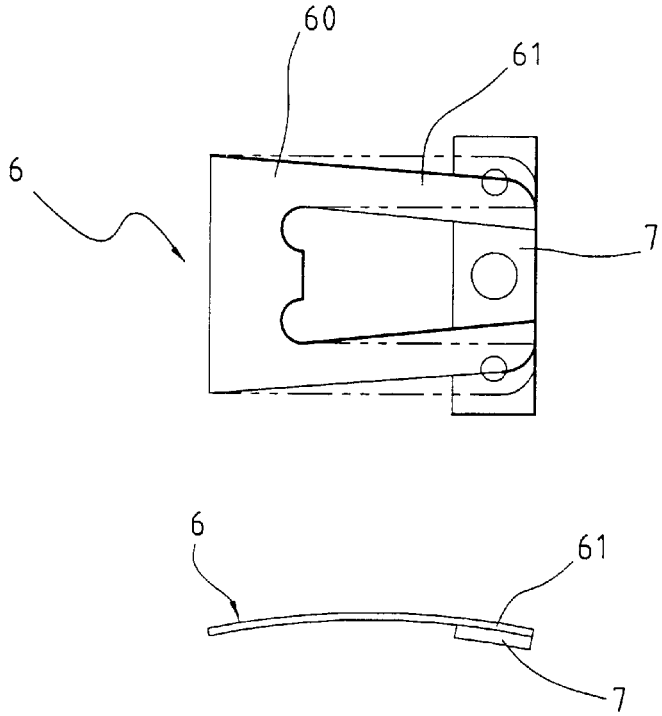
FIG. 8*a* shows the bimetal plate and the conductive member of the switch device of the present invention.
Figure 8B:
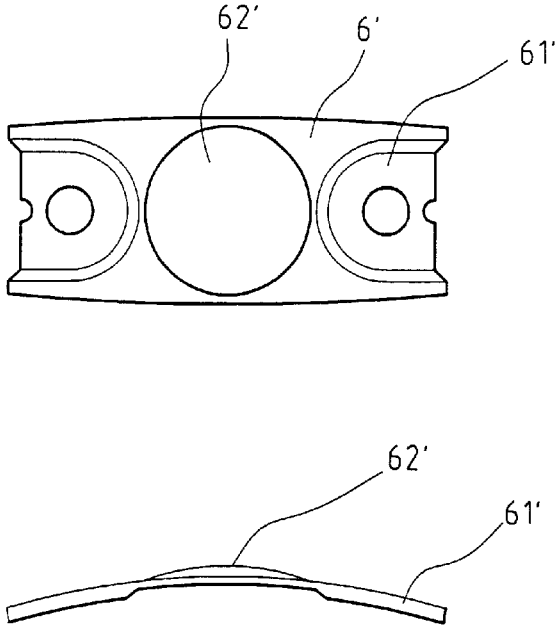
FIG. 8b (Prior Art)
FIG. 8*b* shows a conventional bimetal plate.

Referring to FIG. 8*a*, a bimetal plate 6 has a body 60 and two legs 61 extend from the body 60. The body 60 is connected to the first terminal plate 4 and a conductive member 7 is connected between the two legs 61. The L-shaped non-conductive plate 31 on the button 3 is movably located between the second contact point 71 of the conductive member 7 and the first contact point 51 of the second terminal plate 5.

Figure 4:
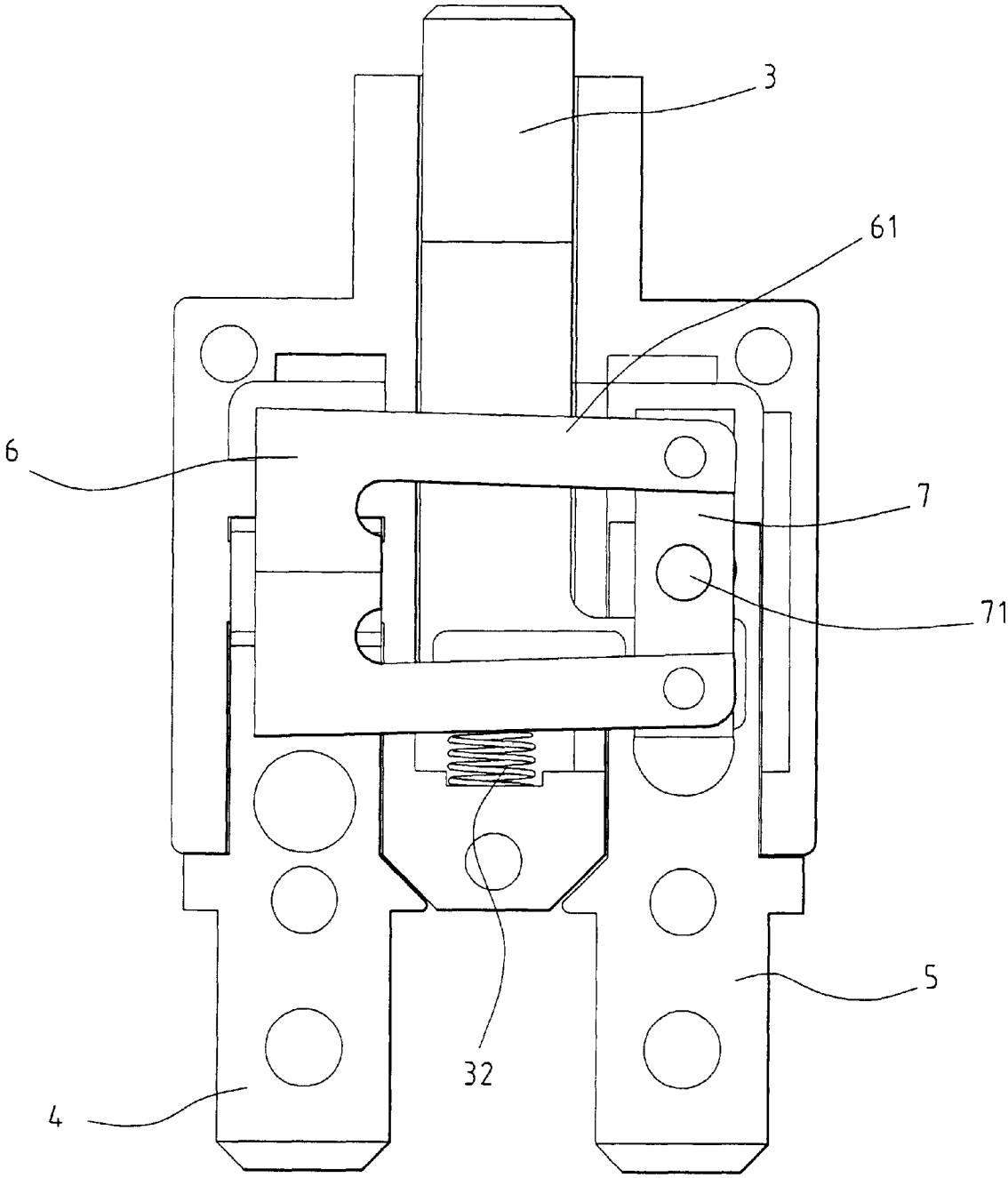
FIG. 4 is a plan view to show the interior arrangement of the switch device of the present invention wherein the button is pushed.
Figure 5:
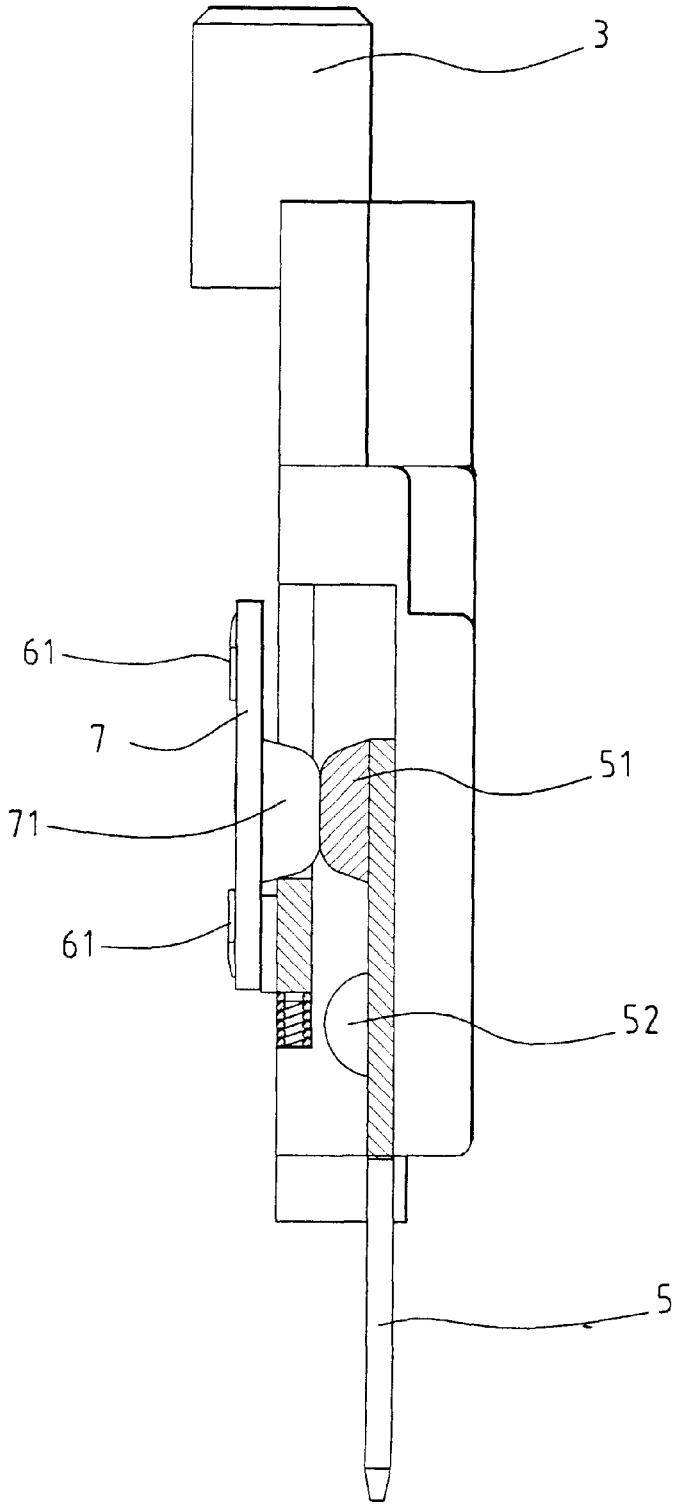
FIG. 5 is a side elevational view to show the non-conductive plate on the button is removed from the first and the second contact points.
Figure 6:
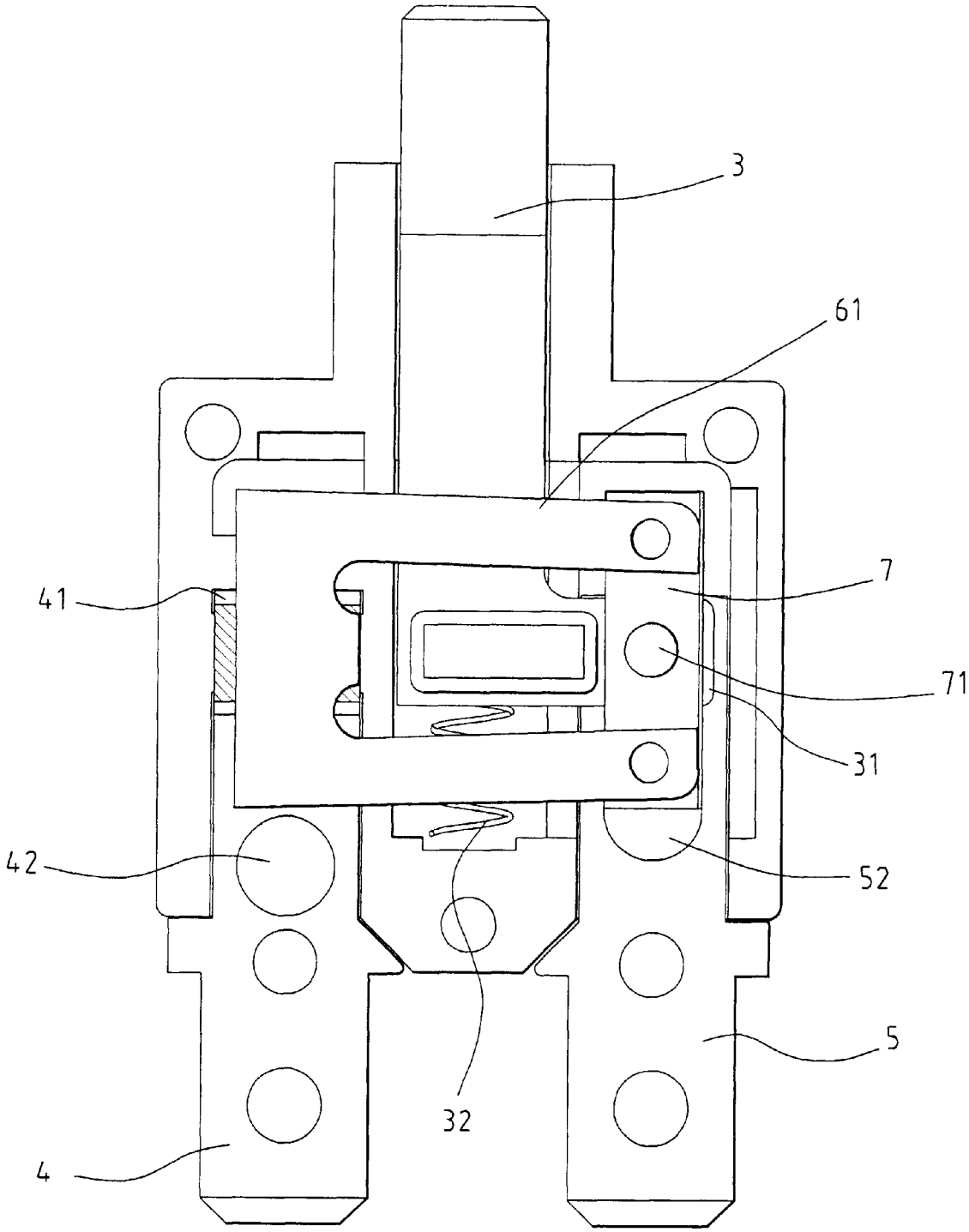
FIG. 6 is a plan view to show the interior arrangement of the switch device of the present invention wherein the button jumps up.
Figure 7:
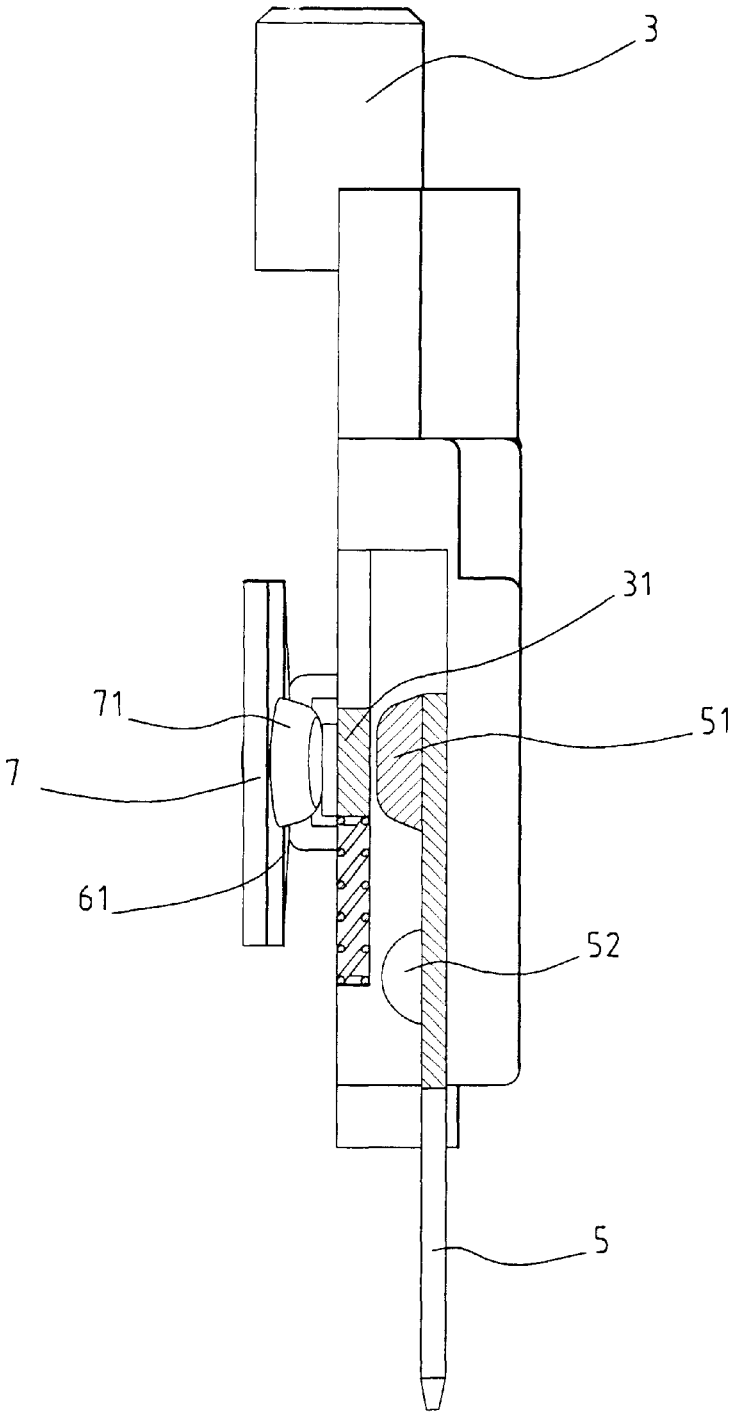
FIG. 7 is a side elevational view to show the non-conductive plate on the button separates the first and the second contact points.

FIGS. 4 and 5 show that when the button 3 is pushed, the spring 32 is compressed and the non-conductive plate 31 is lowered so that the first contact point 51 and the second contact point 71 contacts. The current may pass through the first terminal plate 4, the bimetal plate 6, the second contact point 71, the first contact point 51 and the second terminal plate 5 to form a circuit. FIGS. 6 and 7 show that when the current overrides, the two legs 61 are deformed and move the conductive member 7 away from the second terminal plate 5 and the spring 32 is not stopped by the second contact point 71 so that the spring 32 bounces the button upward. The non-conductive plate 31 is moved upward to be sandwiched between the first contact point 51 and the second contact point 71 to open the circuit.

Figure 9A:
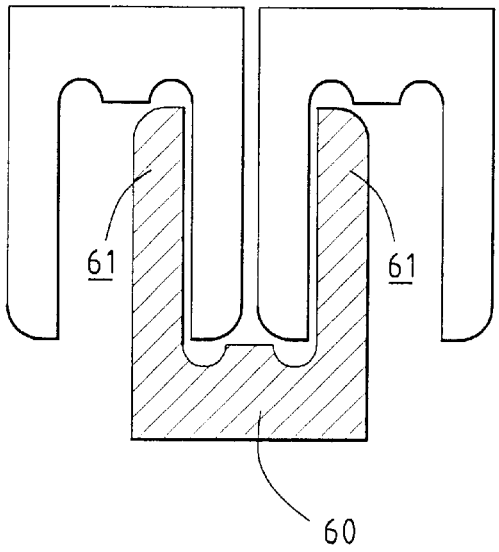
FIG. 9*a* shows a unit of bimetal material can produce three bimetal plates of the present invention.
Figure 9B:
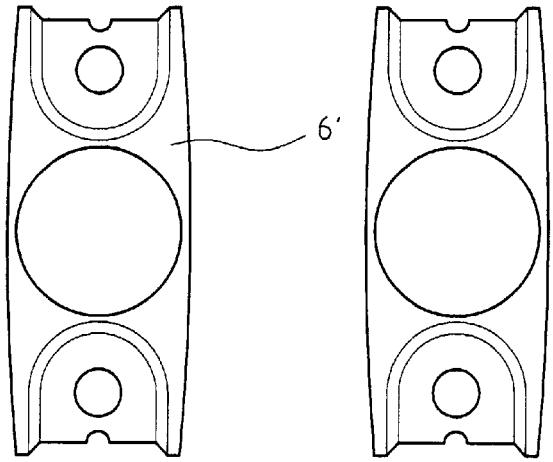
FIG. 9b (Prior Art)
FIG. 9*b* shows that the unit of bimetal material can only produce two conventional bimetal plates.

Referring to FIGS. 9*a* and 9*b*, a unit of bimetal material can produce three bimetal plates 6 of the present invention. However, the same unit of bimetal material can only produce two conventional bimetal plates 6'. Accordingly, the material of the bimetal plate 6 of the present invention is only ⅔ of the conventional bimetal plate 6'. This allows the size of the switch device to be reduced.

While we have shown and described various embodiments in accordance with the present invention, it should be clear to those skilled in the art that further embodiments may be made without departing from the scope and spirit of the present invention.

What is claimed is:

1. A switch device comprising:

a switch case having a passage defined through a top of said case and two slots respectively defined in an underside of said case, a button movably received in said passage and a non-conductive plate extending laterally train said button and located in said switch case, a first terminal plate and a second terminal plate respectively engaged with said two slots, said case being composed of a first part having a plurality of recesses defined in a surface of said first part, and a second part having a plurality of rods extending from said second part for engaging with said recesses; and a bimetal plate having a body and two legs extending from said body, said body connected to said first terminal plate, a conductive member connected between said two legs and said non-conductive plate movably located between said conductive member and said second terminal plate;

wherein each of said first terminal plate and said second terminal plate has a connection hole, and two rivets respectively extend trough said connection holes and engage with two engaging holes defined in said first part.

2. The device as claimed in claim 1 further comprising a first contact point extending from a side of said second terminal plate and a second contact point extending from a side of said conductive member, said non-conductive plate movably located between said first contact point and said second contact point.

3. The device as claimed in claim 1 further comprising a spring biased between said button and an inner periphery of said passage.

4. The device as claimed in claim 1, further comprising a slit defined in said first part, and said first terminal plate having an end engaged with said slit.

5. A switch device comprising:

a switch case having a passage defined through a top of said case and two slots respectively defined in an underside of said case;

a button movably received in said passage and an L-shaped non-conductive plate extending laterally from said button and located in said switch case;

a first terminal plate and a second terminal plate respectively engaged with said two slots;

a U-shaped bimetal plate having a body and two legs extending from said body, said body connected to said first terminal plat; and a conductive member having two end connection points connected to two ends of said two legs, said conductive member having a first contact point extending from a side of said conductive member at a point between said two end connection points;

wherein said L-shaped non-conductive plate has a lateral portion movably located between said conductive member and said second terminal plate.

6. The device as claimed in claim 5, further comprising a second contact point extending from a side of said second terminal plate, said non-conductive plate movably located between said first contact point and said second contact point.

7. The device as claimed in claim 5, further comprising a spring biased between said button and an inner periphery of said passage.

8. The device as claimed in claim 5, wherein said case is composed of a first part having a plurality of recesses defined in a surface of said first part, and a second part having a plurality of rods extending from said second part for engaging with said recesses.

9. The device as claimed in claim 5, further comprising a slit defined in said first part, and said first terminal plate having an end engaged with said slit.

10. The device as claimed in claim 8, wherein each said first terminal plate and said second terminal plate has a connection hole, and two rivets respectively extend through said connection holes and engage with two engaging holes defined in said first part.

* * * * *